US010806271B2

(12) United States Patent
Hyltenfeldt et al.

(10) Patent No.: US 10,806,271 B2
(45) Date of Patent: Oct. 20, 2020

(54) FURNITURE DEVICE WITH ADJUSTABLE FIRMNESS VIA AN ELASTIC MEMBER WITH A COMPRESSIBLE PORTION

(71) Applicant: You Bed AB, Stockholm (SE)

(72) Inventors: Stefan Hyltenfeldt, Norrtälje (SE); Matthias Sörensen, Saltsjö-Boo (SE)

(73) Assignee: You Bed AB, Stockholm (SE)

( * ) Notice: Subject to any disclaimer, the term of this patent is extended or adjusted under 35 U.S.C. 154(b) by 310 days.

(21) Appl. No.: 15/738,176

(22) PCT Filed: Jun. 21, 2016

(86) PCT No.: PCT/EP2016/064309
§ 371 (c)(1),
(2) Date: Dec. 20, 2017

(87) PCT Pub. No.: WO2017/005486
PCT Pub. Date: Jan. 12, 2017

(65) Prior Publication Data

US 2018/0192781 A1 Jul. 12, 2018

(30) Foreign Application Priority Data

Jul. 3, 2015 (SE) ..... 1550955

(51) Int. Cl.
*A47C 23/043* (2006.01)
*A47C 27/06* (2006.01)

(52) U.S. Cl.
CPC ..... *A47C 23/0435* (2013.01); *A47C 27/061* (2013.01); *A47C 27/064* (2013.01)

(58) Field of Classification Search
CPC .. A47C 23/0435; A47C 27/061; A47C 27/064
See application file for complete search history.

(56) References Cited

U.S. PATENT DOCUMENTS 4,827,546 A * 5/1989 Cvetkovic ..... A47C 27/061 297/DIG. 8
8,438,681 B2 * 5/2013 Viberg ..... A47C 23/0435 5/716

(Continued)

FOREIGN PATENT DOCUMENTS

CN 101422305 A 5/2009
CN 102413736 A 4/2012

(Continued)

OTHER PUBLICATIONS

International Search Report and Written Opinion for International Application No. PCT/EP2016/064309 dated Aug. 29, 2016, 10 pages.

(Continued)

*Primary Examiner* — Myles A Throop
(74) *Attorney, Agent, or Firm* — RMCK Law Group, PLC

(57) ABSTRACT

A furniture device configured to receive the weight of a being, said furniture device comprising a holding arrangement (20, 120) and at least one section (30, 30',130) comprising a base (2, 102), a movable plate element (4, 104), a moving mechanism (6, 10) and at least one elastic device (12, 112). The plate element (4, 104) is configured to interact with the at least one elastic device and to be moved by the moving mechanism in respect to the base in order to adjust the firmness of the at least one elastic device. The elastic device comprises a pocket (14, 114) made of a flexible sheet material, and an elastic member (18, 118). The holding arrangement comprises a holding member (22, 122), which is fixed in relation to the base (2, 102) or the plate element (4, 104) and a connecting portion (24, 24',124) which is arranged at the elastic device (12, 112) and which connects the holding member to the elastic member. The elastic member (18, 118) exhibits a first portion (18*a*, 118*a*) arranged proximal to the free end of the elastic member, a (Continued)

second portion (18*b,* 118*b*) being arranged distal to the free end of the elastic member and an intermediate portion (18*c,* 118*c*) arranged between the first and second portions. The holding member (22, 122) is, via the connecting portion (24, 24',124), connected to the intermediate portion (18*c,* 118*c*) of the elastic member, such that, during movement of the plate element (4, 104) relative to the base (2, 102), the elastic member (18, 118) is compressed and relaxed only over the second portion (18*b,* 118*b*).

20 Claims, 5 Drawing Sheets

(56) References Cited

U.S. PATENT DOCUMENTS

| | | | | |
|---|---|---|---|---|
| 2010/0257675 | A1* | 10/2010 | DeMoss | A47C 27/064 5/720 |
| 2011/0148018 | A1* | 6/2011 | DeFranks | A47C 23/0438 267/166.1 |
| 2018/0049559 | A1* | 2/2018 | Jewett | A47C 27/062 |
| 2018/0168360 | A1* | 6/2018 | Thomas | A47C 27/062 |

FOREIGN PATENT DOCUMENTS

| | | | |
|---|---|---|---|
| CN | 102551395 | A | 7/2012 |
| CN | 103355985 | A | 10/2013 |
| CN | 103429119 | A | 12/2013 |
| CN | 105358012 | A | 2/2016 |
| EP | 2245967 | A1 | 11/2010 |
| EP | 2745745 | A1 | 6/2014 |
| EP | 2801297 | A1 | 11/2014 |
| RU | 2308863 | C1 | 10/2007 |
| WO | 2005053466 | A1 | 6/2005 |
| WO | 2014180924 | A1 | 11/2014 |

OTHER PUBLICATIONS

English Translation of Chinese Search Report for Patent Application No. 201680039331.3 dated Aug. 1, 2019, 2 pages.

Russian Search Report dated Jul. 5, 2019 for Application No. 2018102956/12, 2 pages.

* cited by examiner

FURNITURE DEVICE WITH ADJUSTABLE FIRMNESS VIA AN ELASTIC MEMBER WITH A COMPRESSIBLE PORTION

CROSS-REFERENCE TO RELATED APPLICATIONS

This application is a 371 U.S. National Stage of International Application No. PCT/EP2016/064309, filed Jun. 21, 2016, which claims priority to Swedish Application No. 1550955-7, filed on Jul. 3, 2015. The disclosures of each of the above applications are incorporated herein by reference in their entirety.

TECHNICAL FIELD

The invention relates to furniture device, such as a bed or mattress, a seat cushion or the like, adapted to receive the weight of a being. More particularly, the invention relates to such a device which is arranged for adjusting the firmness of a furniture comprising the device.

BACKGROUND

A furniture device, such as a bed or mattress, a seat cushion, or other device, is provided to act on the weight or part of the weight of a being, wherein the device distributes the weight of the body of the being over a part of a surface of the furniture device. Depending on how the device distributes the weight of the being, it will appear as soft or firm. The degree of firmness of such a furniture device is dependent on the properties of the elastic element, such as for example the spring constant or the air pressure. Another parameter that influences the degree of firmness is the arrangement of the elastic element or elements in the furniture device; a pre-tensioned helical spring is harder than a free helical spring, same for an air cushion that pressurized to a high pressure, which is harder than one which is pressurized at a lower pressure. Thus the firmness of a furniture device such as a mattress is usually set during manufacturing.

In known furniture devices with properties according to the field of the invention, the firmness of the device is adjustable by deforming the elastic members and thus pre-tensioning them. A mechanism comprising a deformation member, which is capable of deforming the elastic members is used to adjust the firmness of the device or mattress. The firmness of such furniture devices may be adjusted by the being or the user, even after manufacturing of the device. The firmness of the elastic members may also be adjusted when the furniture is used over a period of time allowing compensating for possible changes of its properties.

Contemporary furniture devices with the above described properties often comprise elastic members with a so called pocket spring design, wherein each elastic member comprises a spring element and a flexible envelope that encloses the spring so that the spring is caught in the flexible envelope. Such pocket spring designs allow each spring to deform itself without affecting the adjacent springs. The pocket spring devices further exhibits great heat conductivity and moisture transportation capability.

When pocket spring devices are used in beds, a mattress topper is normally applied on top of the pocket spring device. The main purpose of the mattress topper is di distribute the pressure exerted by the being over a larger area of the pocket spring device. Normally, a thicker mattress topper will enhance the pressure distribution capability and thereby the load related comfort of the bed. However, a thicker mattress topper reduces the capability of the topper to conduct heat and to transport moisture. Increasing the thickness of the topper thus reduces the comfort with regard to heat and moisture.

WO2005/053466 discloses an upholstered unit such as for example a bed or mattress including a plurality of pocketed springs and at least one inflatable member located above and/or below of at least some of the pocketed springs. WO2005/053466 discloses the use of an inner pocketed spring arranged within an outer pocketed spring, whereby these pocketed springs may be arranged on an inflatable member. The build up of the upholstered unit according to this disclosure is complicated, heavy and due to the many inflatable members proposed also prone to failure.

EP2245967 A1 discloses a furniture device adapted to receive the weight of a being, comprising a section with a fundament, a plate member and a set of elastic members. The elastic members are connected to the fundament via an array of connections, a net member and connection members and they are embedded on the plate member. The plate member is arranged above the fundament with respect to the ground and it can be displaced by a deformation member, thereby pre-tensioning the elastic members. The elastic members comprise an elastic element and a flexible envelope embedding the elastic element. The connection members are attached to the net members and the net member is attached to the array of connections. The net member is a solid grid shaped element. The use of a net member enhances the complexity of manufacturing, build-up and the weight of the furniture device. Further, when the weight of a being acts on the device, it may affect adjacent areas on the same section or neighbouring sections of the device via the net member, since this net member is preferably a solid grid.

WO 2014/180924 A1 discloses a furniture device comprising a base and a plate element which is movable in relation to the base. A holding arrangement comprising a holding member and a connecting portion is arranged to compress at least one elastic device when the plate element is moved relative to the base. According to WO 2014/180924 A1 the elastic device is compressed and relaxed over its entire length when the plate element moves relative to the base.

OBJECT AND SUMMARY OF THE INVENTION

An object of the present invention is to provide an enhanced furniture device which allows adjustment of the firmness.

Another object is to provide such a furniture device at which adjustment of the firmness does not influence the firmness of an upper portion of the furniture device.

A further object is to provide such a furniture device at which deformation induced by a being to one elastic device of the furniture device does not influence neighbouring elastic devices.

Still another object is to provide such a furniture device at which the firmness of the elastic devices may readily be adjusted with a high degree of accuracy.

Yet another object is to provide such a furniture device that is easy to handle, comparably light and easy to manufacture.

Another object of the present invention is to provide a furniture device that is economical.

A still further object of the present invention is to provide a furniture device that is sensitive in use.

These objects are achieved by a furniture device according to claim 1.

The furniture device is configured to receive the weight of a being. It comprises a holding arrangement and at least one section comprising a base, a movable plate element, a moving mechanism and at least one elastic device. The plate element is configured to interact with the at least one elastic device and to be moved by the moving mechanism in respect to the base in order to adjust the firmness of the at least one elastic device. The elastic device comprises a pocket made of a flexible sheet material, and an elastic member, the elastic member being arranged within said pocket, the pocket being attached to adjacent pockets. The attachment is formed so that adjacent elastic devices may move independently from one another along a distance (A), as measured from a free end of the elastic device and in a direction perpendicular to the plate element. The holding arrangement comprises a holding member, which is fixed in relation to the base or the plate element and a connecting portion, which is arranged at the elastic device and which connects the holding member to the elastic member. The holding member is, at each connecting portion, connected to only one or two elastic devices. The elastic member exhibits a first portion arranged proximal to the free end of the elastic member, a second portion being arranged distal to the free end of the elastic member and an intermediate portion arranged between the first and second portions. The holding member is, via the connecting portion, connected to the intermediate portion of the elastic member, such that, during movement of the plate element relative to the base, the elastic member is compressed and relaxed only over the second portion.

By connecting the holding member, at each connecting portion, only to one or two elastic devices maintains the individual characteristics of each elastic device. By this means, neighbouring elastic devices are not influenced when one elastic device is exposed to the weight of a being. This in turn enhances to comfort of the furniture device.

Connecting the holding members to the connecting portions has the advantage that no additional element is needed. That eases the manufacturing and reduces the weight of the bed. In addition it enhances also the sensitivity and reduces the influence on neighbouring sections and individual elastic devices, when the weight of a being is affecting a section or part of a section of the furniture device.

Additionally, the connection of the holding member to the intermediate portion of the elastic member results in that the first portion, i.e. the upper portion of the elastic member, remains unaffected when the second portion is compressed and relaxed. By this means, the upper portion of the section will remain comparatively soft also when the general firmness of the section is increased. This in turn enhances the comfort of the furniture device in use. At some instances the furniture device may thus be comfortably used also without the need of a mattress topper. This in turn naturally reduces the total price of the furniture. Additionally, the very good heat and moisture transportation capabilities of the pocket spring arrangement may be fully utilized unimpeded by any mattress topper. Also when a mattress topper is used, the thickness of the topper may be greatly reduced without reducing the load comfort of the furniture. The reduced thickness of any mattress topper in turn enhances the heat and moisture comfort of the entire furniture.

The intermediate portion may be arranged at a distance D from the free end of the elastic member, which distance D is between one third and one fourth of the axial non-compressed length of the elastic member.

The connecting portion may be arranged at the intermediate portion of the elastic member.

In such an embodiment, the holding members may be directly fixed to the elastic members. Such direct fixing can be advantageous for the durability of the furniture device, since it may reduce the wear of the pockets.

Alternatively, the connection portion may be arranged at the pocket and the pocket may then be connected to the intermediate portion of the elastic member.

At such embodiments, the pocket may be connected to the intermediate portion of the elastic device by any means within the group consisting of a connecting member, sewing, knitting, lashing, adhesion and welding.

The holding member may then be fixed directly to the pocket, at the connecting portion.

The holding member may be fixed relative to the base. At such embodiments the elastic devices may take support on the plate element which is arranged between the base and the elastic devices.

The holding member may then e.g. be a thread or string passing through recesses in the plate element. The plate element may be arranged above the base in respect to the ground. The holding member may be fixed to the base and/or the connecting portions via knots at the two ends and waving through the plate element and connecting portions in between the two ends. The plate element may be displaceable by the moving mechanism away from the base and the ground so that the holding members keep the elastic device in the original position so that the plate element is thus pre-tensioning the elastic devices when it is displaced.

Alternatively, the holding member may be fixed relative to the plate element. At such embodiments the elastic devices may take support on the base and the plate element may be arranged on the side of the base being opposite to the elastic devices.

The elastic devices may then be arranged on the base and the plate element below the base in respect to the ground. The holding member may pass through recesses in the base and it may be fixed to the plate element at the two ends and waving through the base and connecting portions in between. Fixing the ends to either the connecting portions or the base is also possible. The plate element may be configured to be displaced away from the base towards the ground by the moving mechanism in order to pre-tension the elastic devices. In this case the moving mechanism only works against the elastic force of the elastic device.

The holding member may be formed of a rod or a stick or a flexible thread, string or wire.

A string or thread or the like is flexible, soft and easy to handle and install. The string may be made of cotton or a synthetic material.

The holding member may be connected directly to the pocket or the elastic member.

The elastic members may be formed as helical springs.

The helical springs may be made of metal or alternatively of a plastic. Helical springs have good elastic properties and they are easy to obtain and install.

The connecting portions may be arranged on a straight line, which extends through the centre of the helical springs.

The elastic device may have a length (L), as measured perpendicular to the plate element and the distance (A) may be larger or equal to 1/15 of the length (L) and smaller or equal to 2/3 of the length (L).

This ensures that adjacent elastic devices can move independently from one another and that in case the weight of a being is acting on the furniture device or a section of it, a neighbouring being is not disturbed.

The holding member may be connected to multiple connecting portions.

The connecting portions may be formed as passages in the pocket and/or welding seams between adjacent attached pockets and/or glued seams between adjacent attached pockets.

It is possible to combine combinations of different types of connecting portions in one single section. There may be welding seams used in one horizontal direction and glued seams in another direction. It is also possible to use recesses, cut outs or through holes in the pockets and to guide the holding member through those recesses, for example around the edge of a section.

Using different types of connecting portions has advantages during the manufacturing of the furniture device and it may also be advantageous regarding the durability of the furniture device. In case one piece of flexible sheet material is used to produce a plurality of pockets, the welding seams may be established during the manufacturing of the pockets, namely when the material is welded together to form pockets.

The elastic device may comprise more than one elastic member and correspondingly more than one pocket, the elastic member and corresponding pocket being arranged on top of each other.

This enhances the sensitivity of the furniture device and enables a user to adjust the firmness in a fine manner over a certain range.

The pockets may be welded together in one horizontal direction and glued together in another horizontal direction.

The furniture device may be a bed or a mattress comprising a plurality of sections.

Such a bed or mattress may have advantages when it has to be used for various users, such as for example in hotels. Another application may be the treatment of patients with back or hip problems, since the sections allow it to harden the mattress, for example in the area of the buttock and shoulder to straighten the back and hip, thereby allowing to adjusting the mattress for every patient.

The pockets may be attached to adjacent pockets in a manner so that they are not attached to one another along a distance (B) as measured from the plate element in a direction perpendicular to the plate element and wherein the distance (B) is bigger or equal to 1/15 of the length (L) of the elastic device.

The pockets are thus basically only attached to a neighbouring pocket in the region of a mid section. This ensures that the adjustment of the firmness of one section does not influence the neighbouring section, especially in case the one section only comprises a singular elastic device.

One, several or all sections may comprises a singular elastic device.

The section may comprise a layout of 6 times 13 elastic devices.

The holding member may be weaving from one connecting portion through the plate element or base to the base or plate element, where it is attached and back through the plate element or base to another connecting portion and so on.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

Figure 1A:
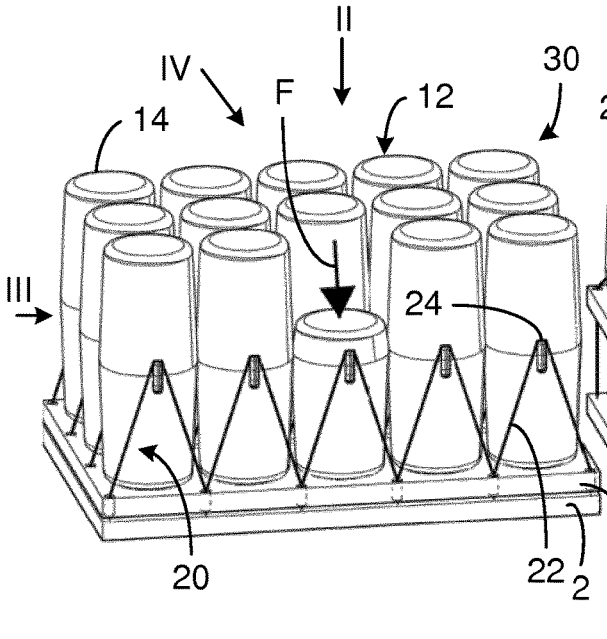
FIG. 1*a* is a perspective view of a section of a furniture device illustrating an embodiment of the invention.

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

FIGS. 1*a* to 2*b* disclose a section 30 and a holding arrangement 20 of an embodiment of the invention. The section 30 may form a part of a furniture device such as a bed-mattress, a sofa or any other upholstered furniture device. The section 30 of the furniture device comprises a base 2, a movable plate element 4, a moving mechanism 6 and at least one elastic device 12, as illustrated in the FIGS. 1*a* to 5*b*. The movable plate element 4 carries and embeds a plurality of elastic devices 12. The amount of elastic devices 12 per section 30 can vary from 1 to a high amount such as for example 400 elastic devices 12 or even more. In the figures an embodiment with 5×3 (thus 15) elastic devices 12 per section and an embodiment with one elastic device 12 per section (FIGS. 5*a* and 5*b*) are illustrated.

Figure 6:
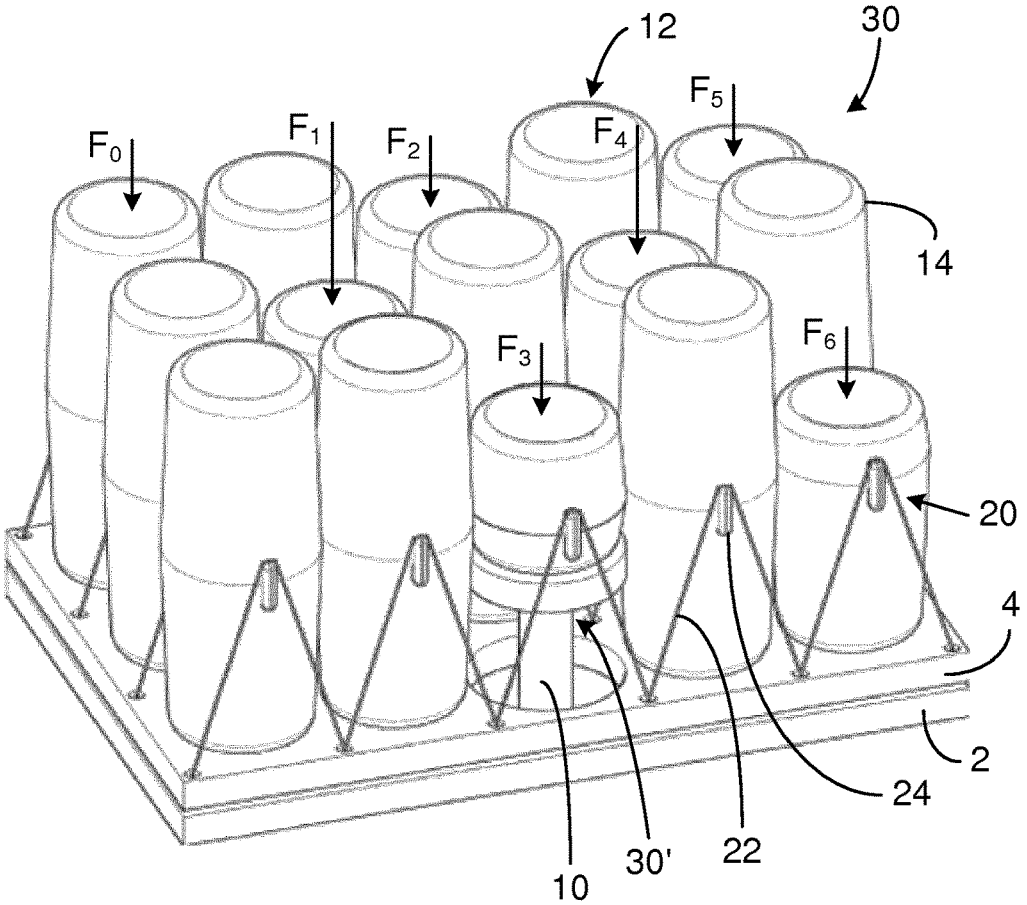
FIG. 6 is a perspective view of a second embodiment of the invention.

The section 30 is configured to receive the weight of being. The weight of being results in a force F, schematically indicated in FIGS. 1*a*, 1*b* and 6. FIG. 6 schematically illustrates how forces with different values $F_0$, $F_1$, $F_2$, $F_3$, $F_4$, $F_5$ and $F_6$ affect the elastic devices 12. $F_0$ has the value zero, thus illustrating the elastic device 12 in the state of rest.

The elastic devices 12 may be fixed to the plate element 4 or arranged standing freely and being held only by the holding arrangement 20 on the plate element 4. The holding arrangement 20 is configured to hold the elastic devices 12 in place, thus it is not necessary to fix the elastic devices 12 to the plate element 4.

Figure 1B:
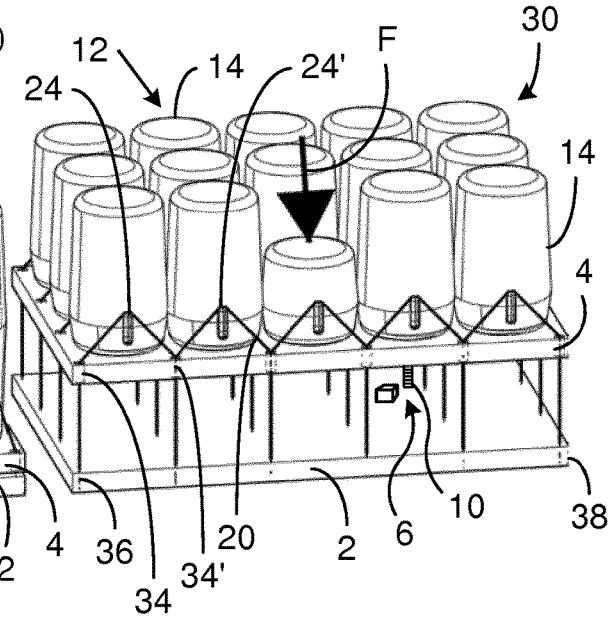
FIG. 1*b* is a perspective view similar as FIG. 1 but with a plate element displaced.

The holding arrangement 20 comprises a holding member 22 and a connecting portion 24. The holding arrangement 20 holds each elastic device 12 in position and limits the vertical movement of the elastic device 12 when the plate element 4 is moved or displaced in a direction perpendicular to the base 2, such as illustrated in FIGS. 1*b* and 1*b*. When the plate element 4 is moved or displaced in respect to the base 2, the elastic devices 12 are pre-tensioned. Moving the plate element 4 thus allows adjusting and changing the firmness of the section 30. A displaced plate element 4, as illustrated in FIGS. 1*b* and 1*b* has the effect that the firmness is harder than when the plate element 4 is not displaced, thus when it is in the original position shown in FIG. 1*a*.

The elastic devices 12 comprise a pocket 14 and, embedded in the pocket 14, an elastic member 18. The pocket 14 may be made of an flexible sheet material, e.g. a fabric such as cotton or preferably, a synthetic fabric that can be welded together by a suiting machine. The elastic member 18 is best illustrated in FIGS. 2*a*-3*b*. In the illustrated embodiments, the elastic member 18 is a helical spring 26, for example made of metal or plastic.

Figure 3:
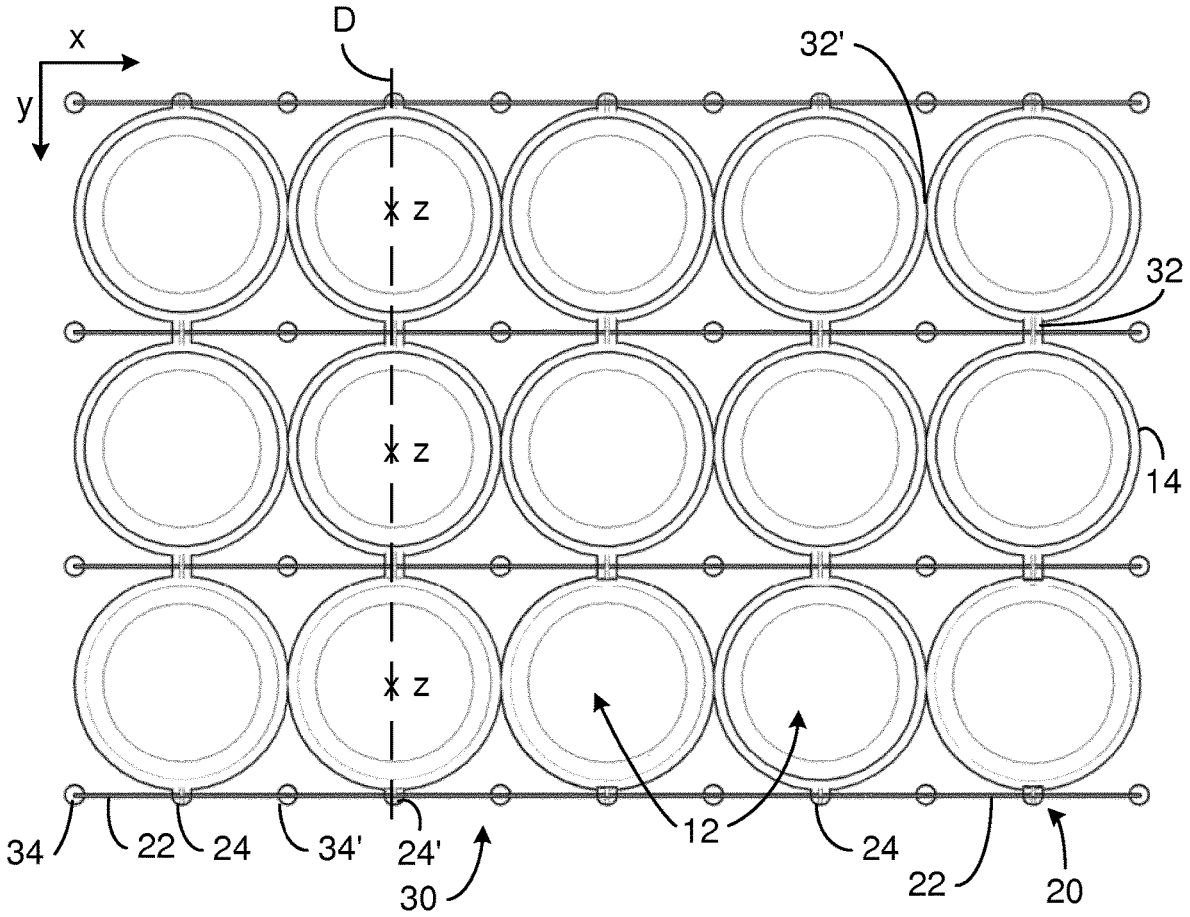
FIG. 3 is a top down view along of the section shown in FIG. 1*a;*
Figure 4:
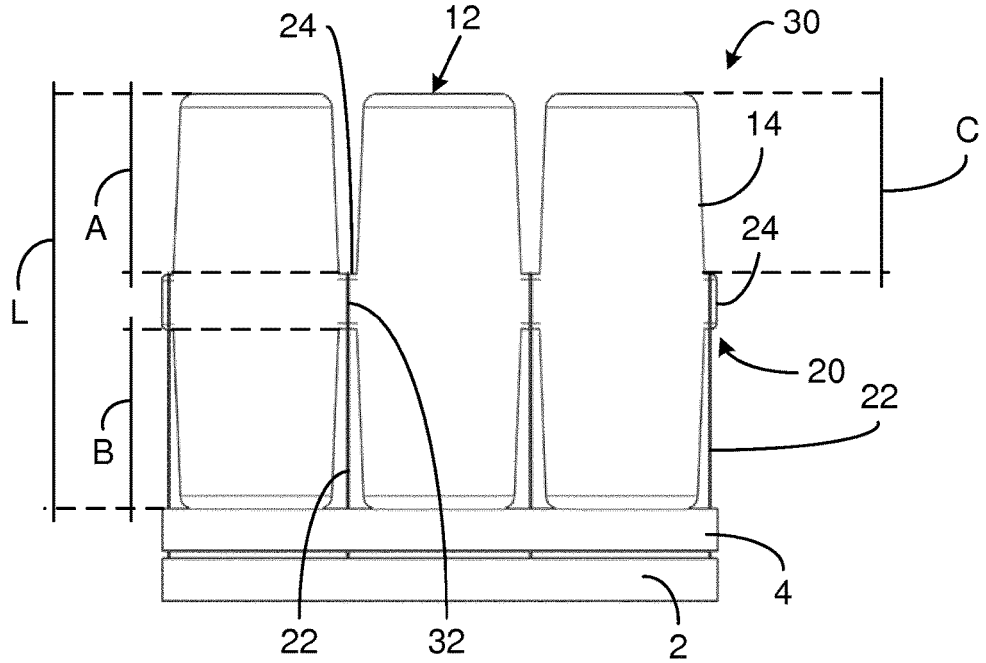
FIG. 4 is a side view of the section shown in FIG. 1*a;*
Figure 5:
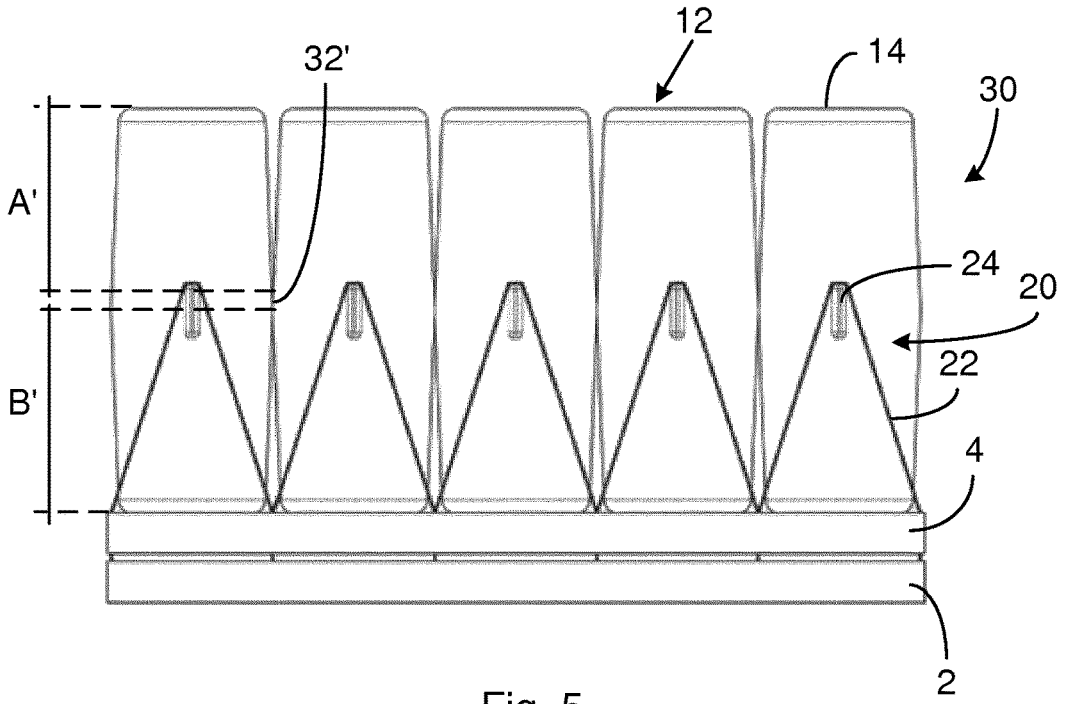
FIG. 5 is a rear view of the section shown in FIG. 1*a;*

The pockets 14 may be attached to adjacent pockets 14 by welding or gluing, thereby forming an attachment 32, 32' as best shown in FIGS. 3 and 4. In the shown embodiment, the pockets are welded together in one direction (Y) and glued together (X) in the other direction, as illustrated in FIGS. 4-6. It is possible and within the scope of the invention to use the same method for attaching the pockets 14 to one another in both directions. The attachment 32 between two pockets 14 may be used to connect the holding member 22 to the elastic device 12, however this is not mandatory. It is possible to connect the holding member 22 to the elastic device 12 separately from the attachment 32, as will be discussed below.

As best seen in FIGS. 2*a*-*b* and 7*a*-*b*, the elastic members 18, 118 comprise a first portion 18*a*, 118*a*, which is arranged proximal to the upper, free end of the elastic members 18, 118. A second portion in, 118*b* is arranged distal to free end of the elastic members 18, 118. An intermediate portion 18*c*, 118*c* is arranged between the first 18*a*, 118*a* and second 18*b*, 118*b* portions.

According to the invention, movement of the plate element 4, 104 relative to the base 2, 102, causes compression and relaxation only of the second portion 18*b*, 118*b* of the elastic member.

At the embodiment shown in FIGS. 2*a*-6, this is accomplished in that the holding member 22 of the holding arrangement is connected to the pocket 14 which in turn is connected to the intermediate portion 18*c* of the elastic member 18. The connection between the pocket and the intermediate portion 18*c* is, in the shown example, achieved by means of a connecting member 15 in the form of an annular element which receives the intermediate portion 18*c* of the elastic member 18 and is fixed to the pocket 14. The shown annular element may be formed by a metallic or plastic ring which is fixed to the inside of the pocket 18 by sewing. However, the connection between the pocket and the intermediate portion 18*c* of the elastic member 18 may also be accomplished by other means. E.g. the intermediate portion may be directly fixed to the pocket by means of welding, adhesion, stitches, or lashing. The intermediate portion 18*c* may also or alternatively be indirectly fixed to the pocket by means of any other type of connecting member.

Figure 2A:
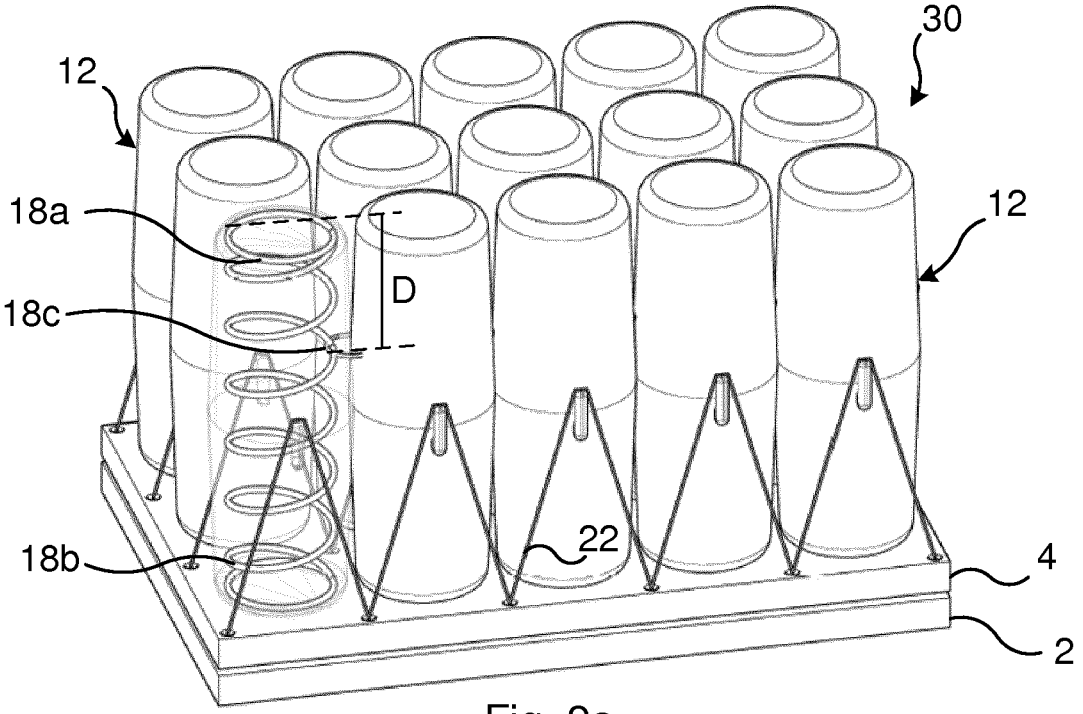
FIGS. 2*a* and 2*b* are perspective views corresponding to FIGS. 1*a-c*, with some elastic devices made transparent
Figure 2B:
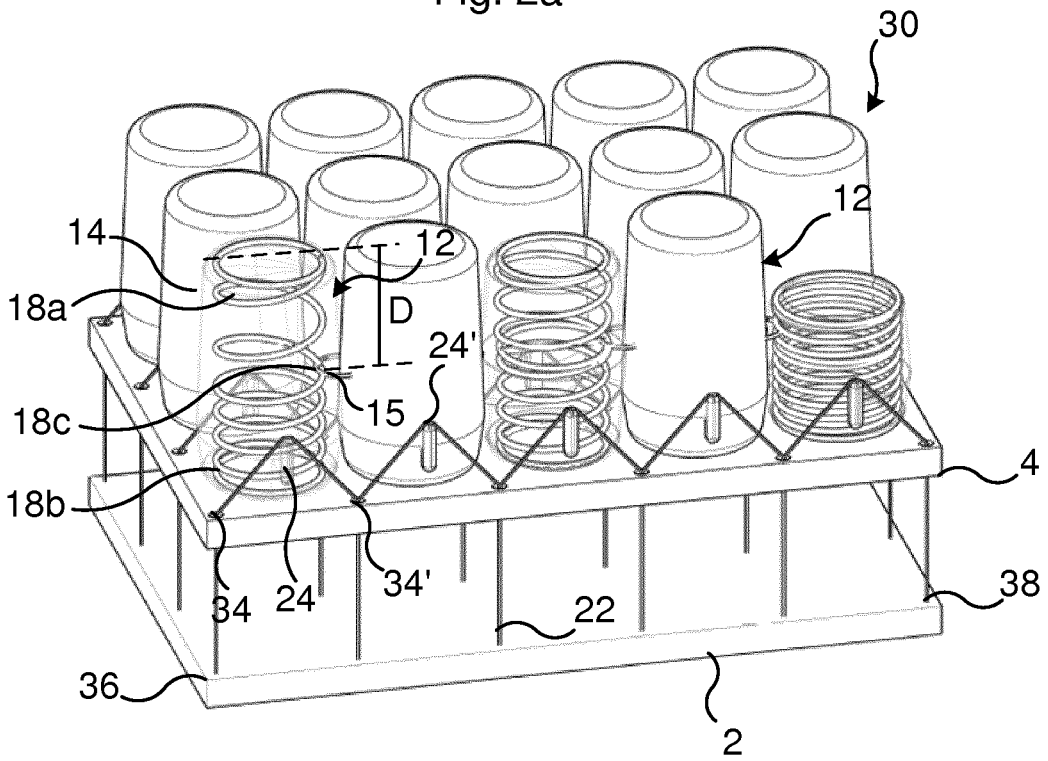

In the example shown in FIGS. 2*a*-*b*, the holding member 22 is formed of a flexible string of cotton. The holding member may however be formed also of many other thread- or string like materials.

The holding member 22 is connected to the base 2 with a first end 36 and then guided up through a recess 34 in the plate element 4 to the connecting portion 24, down through the next recess 34' to the base 2 and therefrom up through the same recess 34' to the next connecting portion 24' and so on, weaving from one connecting portion 24 to the next connecting portion 24' and so on, as best illustrated in FIG. 2*b*. The base 2 may comprise orifices or grommets (not shown) used to attach the holding member 22 to the base 2. The holding member 22 may be connected to the base 2 with a second end 38, as illustrated in FIG. 1*b*. At the first end 36 and the second end 38, the holding member 22 may be rigidly fixed to the base 2, which means that it cannot be moved along its longitudinal, whereas in between these first and second ends 36, 38 the holding member 22 may be loosely attached to the base 2, which means that the holding member 22 is connected to the base 2 so that it may move along its longitudinal direction, for example by using grommets or the like. Alternatively the holding member 22 may also be rigidly fixed to the base 2 in between the first and second ends 36, 38.

At these embodiments, the connecting portions 24 are arranged at the pockets 14 such that the holding member is connected to the pockets at respective connecting portions 24. The connecting portions 24 and the holding member 22 are arranged such that the holding member 22 is connected to either one or two pockets at each connecting portion. For example, in FIGS. 2*a* and 2*b*, the holding member 22 arranged at an outer row of elastic devices 12 is, at each connecting portion 24, connected to only one pocket. On the other hand, the holding members, being arranged between adjacent rows of elastic devices are, at each connecting, portion connected to two adjacent pockets. At this embodiment, each elastic device is thus provided with two connecting portions. It is however also possible that each elastic device is provided with only one or several connecting portions When adjusting the firmness of the section illustrated in FIG. 2*a*, the plate element (4) is driven to be displaced upwards as seen in the figure, away from the base 2. This may be accomplished by means of a moving mechanism (not shown in FIG. 2*a*-*b*) such as mandrel driven by an electrical motor. However, the displacement of the plate element relative to the base may be accomplished also in many other ways, known per se.

During upward displacement of the plate element 4, the holding members 22 will maintain the connecting portions 24 of the pockets 14 at a constant distance from the base 2, whereas the lower end of the elastic devices 12 will be displaced upwards, together with the plate element 4. Also the vertical distance between the connecting portions 24 and the connecting member 15, at each pocket will remain constant. By this means the second portion 18*b* being arranged below the intermediate portion 18*c* of the elastic member 18 will be compressed, whereas the first portion 18*a* arranged above the intermediate portion 18*c*, will remain unaffected. The adjustment of the firmness of the section thus results in that only the lower portions of the elastic devices achieves and increased firmness, whereas the upper portion of the elastic devices will maintain its original firmness or softness.

When the desired firmness of the section has been achieved, the movement of the plate element is stopped and the section has then assumed the state of operation shown in FIG. 2*b*. When it is desired to decrease the firmness of the section, the plate element is displaced downwards towards the position shown in FIG. 2*a*, whereby the second portions 18*b* of the elastic members 18 are relaxed and eventually the section assumes its original firmness when the section again has assumed the state of operation shown in FIG. 2*a*.

The moving mechanism 6 may comprise a mandrel 10 and drive combination, whereby the drive may be an electric motor connected to the 3*o* mandrel for example via a belt or chain or the like. The moving mechanism may comprise more than one mandrel 10 so that the plate element can be displaced symmetrically. The drive or electric motor may comprise a user interface configured to control the displacement of the plate element.

At the embodiment shown in FIGS. 1*a*-6, the holding member 22 is a continuous string or thread connected to a plurality of connecting portions 24. As best seen in FIG. 3, the holding members 22 may extend along the X-direction and connect a plurality, in the present case five, of elastic devices 12 via the connecting portions 24. It is possible to have additional holding members 22 extending in the Y-direction thus having holding members 22 in the X- and Y-direction. Alternatively it is also possible to only have holding members 22 extending in the Y-direction. The connecting portion 24 may need to be arranged accordingly, so that they are arranged on a line D, which extends through the centres Z of the elastic devices 12.

In case the connecting portions 24 are welded or glued, the holding member 22 may be guided around these weldings or gluings, as illustrated in the figures. In an alternative embodiment the connecting portions 24 may comprise passages in the pocket 14 and the holding member 22 may be guided through said passages (not shown). Various combinations of different types of connecting portions 24 may be used in one single section 30. The type of connecting portion 24 used may also depend on the manufacturing of the section 30.

The attachment 32, 32' between pockets is best illustrated in FIGS. 3 and 4. In the X-direction the pockets 14 may be attached differently to adjacent pockets 14 than in the Y-direction. FIG. 4 illustrates the attachment 32 in the Y-direction, this attachment 32 is done by welding two layers of fabric together and FIG. 4 illustrates the attachment 32' in the X-direction, which is done by gluing using adhesive or a glue or the like.

Turning now to FIG. 4, it can be noted and seen that the attachment 32 is done in a mid-section of the elastic device 12. The attachment 32 may comprise a grommet or the like to securely guide the holding member 22. In order to ensure a proper functioning of the furniture device, the elastic devices 12 may not be attached to adjacent elastic devices 12 all the way, which means, that the elastic devices 12 are kept free and independent from adjacent elastic devices 12 in an upper end region, which extends from the free end of the elastic device 12. Each elastic device 12 is thus able to move freely and independently from adjacent elastic devices 12 along a distance A as measured from the free end of the elastic device 12 to the upper end of the attachment 32. Further, each elastic device 12 is also able to move freely and independently from adjacent elastic devices 12 along a distance B as measured from the plate element 4 towards a lower end of the attachment 32. The attachment 32 shown in FIG. 3 is preferably a welded attachment 32, whereby it is formed by welding two layers of fabric, used for forming and manufacturing the pockets 14, together. Keeping the elastic device 12 free from any attachment 32 along a distance B ensures that the firmness of two adjacent sections 30 of a furniture device can be adjusted independently from one another.

The distance A may be larger or equal to 1/15 of the total length L of the elastic device 12 and smaller or equal to 2/3 of the length L. The distance B may be larger or equal to 1/15 of the total length L of the elastic device 12 and preferably smaller or equal to 2/3 of the total length.

Distance C, as measured from the free end of the elastic device 12 to the upper end of the connecting portion 24, indicates where the connecting portion 24 is arranged, as illustrated in FIG. 3. C may be equal to or larger than zero and it does not necessarily need to correspond to the distance A, which is measured between the upper end of the attachment 32 and the free end of the elastic device 12. The holding member 22 may be connected to the elastic device 12 at a point or in a region that differs from the attachment 32, 32'.

FIG. 5 illustrates the attachment 32' in the X-direction. This attachment may be a glued attachment 32'. The distances A' and B' correspond to the distances shown in FIG. 3, however they do not need to be the same, which means the distance A between the upper end of the glued attachment 32' and free end of the elastic device 12 and the distance A' between the upper end of the welded attachment 32' and the free end can be and most likely will be different from one another. The same is valid for the distance B and B'; the distance B between the lower end of the welded attachment 32 and the plate element 4 and the distance B' between the lower end of the glued attachment 32' and the plate element 4 can be and most likely will be different from one another. Both distances A and A' should be equal or larger than 1/15 and smaller or equal to 2/3 of the length L of the elastic device and the distances B and B' should be equal or larger than 1/15 of the length L.

It is to be noted that the smallest distance of A and A' determines the distance along which an elastic device 12 can be compressed independently from an adjacent elastic device 12, thus without influencing adjacent elastic devices 12, when the weight of a being is acting on the furniture device. Further, the smallest distance of B and B' determines the how the displacement of the plate element 4 and a displacement of a plate element of an adjacent section may differ.

FIGS. 4 and 5 illustrate that the elastic devices 12 and thus the pockets 14 and the elastic members 18 bulge in the middle. This may be advantageous for establishing the attachments 32, 32', however, the elastic devices 12 may be in the shape of a symmetrical cylinder or any other suitable shape and thus not bulging in the middle.

The welded attachment 32 may be formed during the manufacturing of the elastic device 12. Thereby a plurality of elastic members 18 may be arranged on a comparably large fabric, then the fabric may be folded on top of the elastic members 18 in order to cover them and in a next step a welding machine or the like may be used to establish welding seams in between the elastic members 18 in order to enclose the said elastic members 18 in pockets 14. The welding machine may be configured to additionally separate the pockets from one another where it is needed in order to establish the free distances A and B as described above. A plurality of such welded rows of elastic devices 12 may then be glued together to form an array of elastic devices 12, which array may be used for and installed on a section 30.

FIG. 6 illustrates a section 30 with a plurality of elastic devices 12 and therein integrated a section 30' comprising a singular elastic device 12. The distance B, B'(not illustrated in FIG. 6) should in this case preferably be larger or at least equal to 1/15 of the length L of the elastic device 12 in order to enable the section 30' comprising the singular elastic device 12 to move independently from the section 30 comprising the plurality of elastic devices 12. The embodiment shown in FIG. 5 may comprise a moving mechanism comprising for example a gearing mechanism or multiple drives so that the section 30' may be displaced independently from the section 30. A mandrel may be used to displace the section 30' via the drive. The integrated section 30' may also be a row or column of a plurality of elastic devices 12. The section 30' may have any other shape. Integrating a section 30' in another section 30 may have the advantage to adjust the firmness of the furniture device in various areas for specific needs.

Figure 7A:
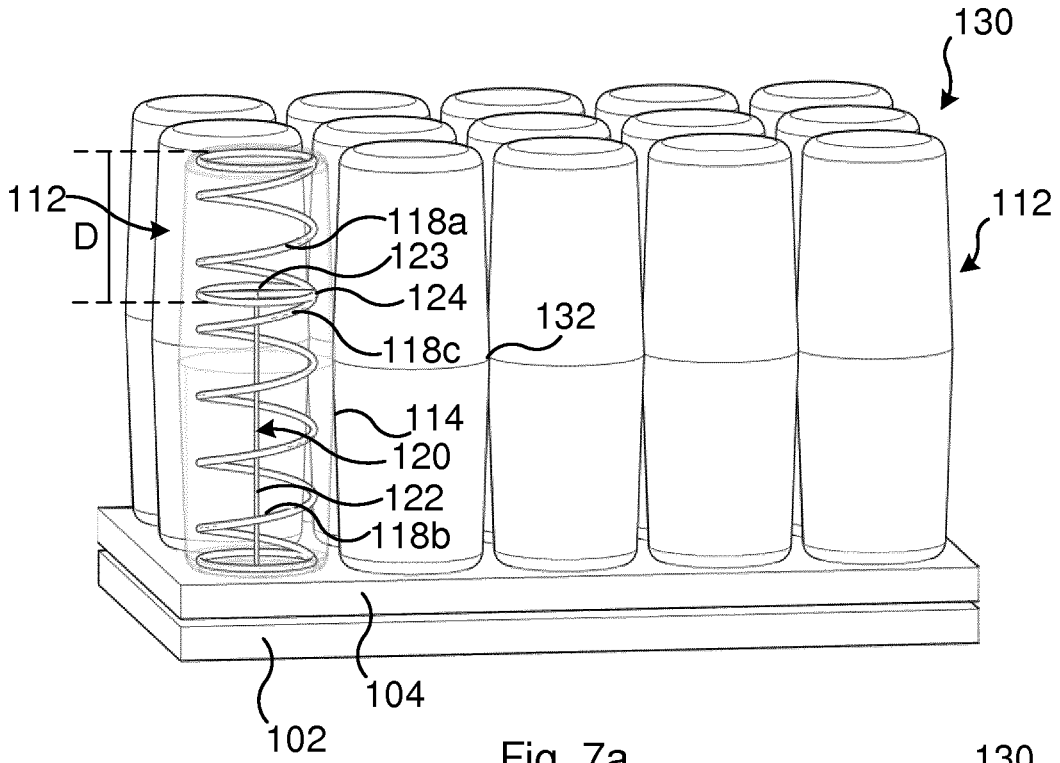
FIGS. 7*a-b* are perspective views corresponding to FIGS. 2*a-b* illustrating a third embodiment of the invention.
Figure 7B:
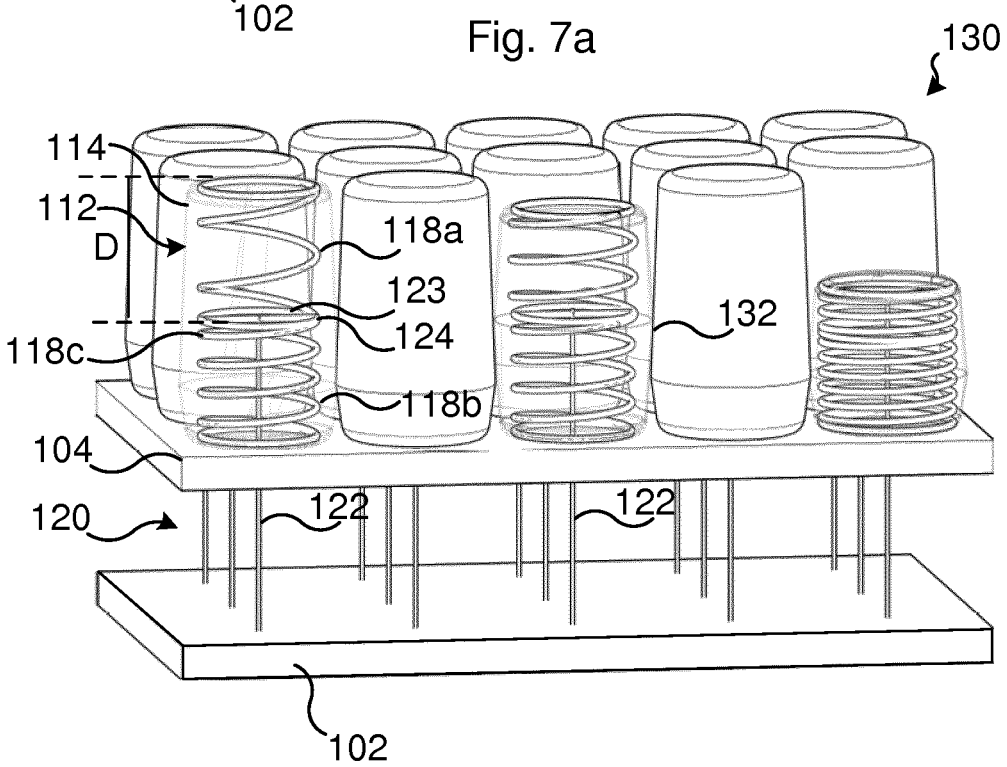

At an alternative embodiment shown in FIGS. 7*a-b*. the holing member 122 is instead connected directly to the elastic members 118, via a connecting portion 124, which is arranged at the intermediate portion 118*c* of the elastic member 118. Here, the holding arrangement 120 comprises a plurality of holding members 122, each holding member being fixed in relation to the base 102. In the shown example each holding member 122 comprises a thin rod, e.g. of metal or plastic. However, the holding members may also in this embodiment be formed of strings, threads wires or the like, as long as they are able to withstand longitudinal stretching forces without exhibiting any substantive prolongation. The holding members 122 extend trough openings (not visible) in the plate element 104.

At the upper end, being distal to the base 102, the holding members 122 exhibits an engagement portion 123 which engages the connecting portion 124 arranged at the intermediate portion 118*c* of the elastic member 118. At the shown example, the engaging portion 123 is formed as an annular member having essentially the same or a slightly greater diameter than the elastic member 118 at the intermediate portion 118*c*. The annular member is arranged in a plane which is perpendicular to the longitudinal axis of the elastic member 118. It further comprises a radial crossbar which is fixed to the upper end of the rod. By this means the engagement portion 123 of the holding member 122 may securely engage the intermediate portion 118*c* of the elastic member 18. The connection between the holding members and the intermediate portion of the elastic members may however be achieved in other ways. E.g. at a not shown example, the holding member may, at its upper end be provided with a loop or the like, which receives a wire or other connecting member which in turn is fixed to the intermediate portion of the elastic member. It may be desirable that the holding member is connected to several points of the intermediate portion. At such instances several, e.g. three, connecting members may at one respective end be fixed to respective points distributed along the circumference of the intermediate portion and by the other ends to a loop or the like at the upper end of the holding member.

Also at this embodiment, the firmness of the section is increased by displacing the plate element 104 upwardly from the starting position shown in FIG. 3*a*. During such displacement, the lower ends of the elastic members 118 will follow the plate element 104 upwardly. The fixation of the holding members 122 to the base 102 and their engagement with the respective intermediate portions 118*c* of the elastic members 118 will maintain the intermediate portions 118*c* at a constant distance from the base 102. By this means, only the second, lower portions 118*b* of the elastic members 118 will be compressed, thereby increasing the firmness only of these portions.

As illustrated in FIGS. 2*a-b* and 7*a-b* respectively, the intermediate portion 18*c*, 118*c* is arranged at a distance D from the upper, free end of the elastic member 18, 118. The corresponding first portion 18*a*, 118*a* extending along this distance D will thus remain unaffected also when the second portion in, 118*b* is compressed for increasing the firmness of the section. By this means, the upper portion of the section 30, 130 remains comparatively soft also when the overall firmness of the section is increased. This in turn allows for that that the thickness of a mattress topper may be reduced or that the mattress topper even may be dispensed with while still maintaining the load comfort of the furniture. It has proven that the distance D should preferably be between ¼ and ⅓ of the total length L of the elastic member 18, 118 for achieving the desired independency of the upper portion while still allowing excellent adjustment of the overall firmness of the section.

In an alternative embodiment (not shown) the plate element may be arranged below the base in respect to the ground and it may be configured to be displaced towards the ground. In such an alternative embodiment, the elastic devices may be embedded on the base and the base may comprise recesses through which the holding members may be guided to be connected to the plate element in this case. In such a solution the plate element may move the holding members, which then pre-tension the elastic devices, whereas the elastic devices are stationary and embedded on the base. In such an embodiment the holding member may be connected to the plate element with a first end and then be guided through the base to the connecting portion then back through the base to the plate element back through the base to the next connecting portion weaving from connecting portion to the next connecting portion and so on. Such an embodiment of the section may preferably be used for a bed or mattress comprising only one single section, since the displacement of the plate element actually causes a change of the level or height of the upper surface of the section and thus the mattress. In addition, it is possible with such an embodiment, to adjust the height of the upper surface of a furniture device, such as a mattress for example.

The section 30, 30' may be installed in a mattress of a bed in a sofa or in a special medical device or medical bed. A furniture device may comprise one or more than one section 30 and it is also conceivable to combine a described embodiment of a section 30 with a conventional mattress so that a user may adapt and modify her/his furniture device, even after buying it.

Further, the embodiments shown in the figures comprise one layer of elastic devices 12 per section 30, however a section may comprise two or more layers of elastic devices 12, whereby the elastic devices 12 are attached to one another via their respective front sides, for example by gluing. In such an embodiment the elastic devices 12 are arranged on top of one another.

In another embodiment of the invention a pocket may comprise two or more elastic members, arranged on top of one another, but still embedded in the same pocket.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A furniture device configured to receive the weight of a being, said furniture device comprising a holding arrangement and at least one section comprising a base, a movable plate element, a moving mechanism and at least one elastic device, the plate element being configured to interact with the at least one elastic device and to be moved by the moving mechanism in respect to the base in order to adjust the firmness of the at least one elastic device, the elastic device comprising a pocket made of a flexible sheet material, and an elastic member, the elastic member being arranged within said pocket, the pocket being attached to adjacent pockets whereby the attachment is formed so that adjacent elastic devices may move independently from one another along a distance, as measured from a free end of the elastic device and in a direction perpendicular to the plate element, the holding arrangement comprising a holding member, which is fixed in relation to the base or the plate element and a connecting portion which is arranged at the elastic device and which connects the holding member to the elastic member, wherein the holding member, at each connecting portion, is connected to only one or two elastic devices characterized in that the elastic member exhibits a first portion arranged proximal to the free end of the elastic member, a second portion being arranged distal to the free end of the elastic member and an intermediate portion arranged between the first and second portions, wherein the holding member, via the connecting portion is connected to the intermediate portion of the elastic member, such that, during movement of the plate element relative to the base, the elastic member is compressed and relaxed only over the second portion.

2. Furniture device according to claim 1, wherein the intermediate portion is arranged at a distance D from the free end of the elastic member, which distance D is between ¼ and ⅓ of the axial length of the elastic member.

3. Furniture device according to claim 1, wherein the connecting portion is arranged at the intermediate portion of the elastic member.

4. Furniture device according to claim 1, wherein the connection portion is arranged at the pocket and wherein the pocket is connected to the intermediate portion of the elastic member.

5. Furniture device according to claim 4, wherein the pocket is connected to the intermediate portion of the elastic member by any means within the group consisting of a connecting member, sewing, knitting, lashing, adhesion and welding.

6. Furniture device according to claim 1, wherein the holding member is fixed relative to the base.

7. Furniture device according to claim 1, wherein the holding member is fixed relative to the plate element.

8. Furniture device according to claim 1, wherein the holding member is a rod or a stick or a flexible thread, string or wire.

9. Furniture device according to claim 1, wherein the holding member is connected directly to the pocket or the elastic member.

10. Furniture device according to claim 1, wherein the elastic members are helical springs.

11. Furniture device according to claim 1, the elastic device having a length, as measured perpendicular to the plate element, wherein the distance is larger or equal to 1/15 of the length and smaller or equal to ⅔ of the length.

12. Furniture device according to claim 1, wherein the holding member connects to multiple connecting portions.

13. Furniture device according to claim 1, wherein the connecting portions are:

passages in the pocket and/or welding seams between adjacent attached pockets and/or glued seams between adjacent attached pockets.

14. Furniture device according to claim 1, wherein the elastic device comprises more than one elastic member and correspondingly more than one pocket, the elastic member and corresponding pocket being arranged on top of each other.

15. Furniture device according to claim 1, wherein the pockets are welded together in one horizontal direction and glued together in another horizontal direction.

16. Furniture device according to claim 1, wherein the furniture device is a bed or a mattress comprising a plurality of sections.

17. Furniture device according to claim 1, wherein the pockets are attached to adjacent pockets in a manner so that they are not attached to one another along a distance as measured from the plate element in a direction perpendicular to the plate element and wherein the distance is bigger or equal to 1/15 of the length of the elastic device.

18. Furniture device according to claim 1, wherein each section comprises a singular elastic device.

19. Furniture device according to claim 1, wherein the section comprises a layout of 6 times 13 elastic devices.

20. Furniture device according to claim 1, wherein the holding member is weaving from one connecting portion through the plate element or base to the base or plate element, where it is attached and back through the plate element or base to another connecting portion and so on.

* * * * *